United States Patent [19]

Patry

[11] 3,959,645

[45] May 25, 1976

[54] BRACKET AND LAMP GLOBE MOUNTING APPARATUS

[76] Inventor: Leon R. Patry, 3977 Medina Road, Medina, Ohio 44256

[22] Filed: May 28, 1974

[21] Appl. No.: 473,874

[52] U.S. Cl. ..... 240/84; 240/73 BA; 248/221 E

[51] Int. Cl.[2] ..... F21S 13/14

[58] Field of Search ..... 240/84, 81 R, 81 A, 240/81 LD, 81 BS, 81 BA, 81 BC, 81 BD, 81 BE, 73 BA, 73 R, 25, 78 F; 248/221, 230

[56] References Cited

UNITED STATES PATENTS

| | | | |
|---|---|---|---|
| 551,358 | 12/1895 | Benecke | 240/81 BS |
| 2,215,331 | 9/1940 | Marsh | 240/78 F |
| 2,728,848 | 12/1955 | Learrington et al. | 240/84 X |
| 2,761,643 | 9/1956 | Ward et al. | 248/230 |
| 3,050,620 | 8/1962 | Schlosser et al. | 240/25 |
| 3,349,239 | 10/1967 | Fahey, Jr. et al. | 240/84 X |
| 3,509,678 | 5/1970 | Dake | 248/221 X |
| 3,678,265 | 7/1972 | Porter et al. | 240/25 X |
| 3,683,172 | 8/1972 | Noyes | 240/25 X |

FOREIGN PATENTS OR APPLICATIONS

| | | | |
|---|---|---|---|
| 1,122,167 | 1/1962 | Germany | 240/84 |
| 838,008 | 5/1958 | United Kingdom | 240/81 A |

*Primary Examiner*—L. T. Hix
*Assistant Examiner*—E. M. O'Connor
*Attorney, Agent, or Firm*—Oldham & Oldham Co.

[57] ABSTRACT

Bracket and globe mounting apparatus including a plurality of brackets of the same shape and including cup-shaped sockets adapted to receive a carrier tube extending therebetween when one bracket engages a support post and a second bracket engages an auxiliary tubular support for a lamp globe or the like. The carrier tube is adapted to receive electric starter means therein for connection to the remaining electrical means in the lamp globe apparatus. The brackets are so shaped so that several may be positioned around the support post in abutting engagement.

2 Claims, 6 Drawing Figures

BRACKET AND LAMP GLOBE MOUNTING APPARATUS

BACKGROUND OF INVENTION

At this time, there are a lot of outdoor lamp support posts in use both in residences and in commercial areas. Many of these lamp support posts are adapted to support a plurality of lamp globes or other lamp means on the post in association with each other. In the positioning of these lamp globes on a common post, it is necessary to provide a relatively wide lateral spacing of the globes or other lamp means because they normally project laterally appreciably from the support member therefor. Thus, the apparatus usually includes a center support post and a plurality of laterally extending support means for the individual globes, which support means usually include a horizontal member and a vertically extending member on which the actual lamp and globe member is positioned. The support apparatus also must be of attractive design. The horizontal and vertically extending members have been made as unitary castings or brackets.

As many of these globe lamps require some sizable starter members, it has been a problem as to how these starter members can be positioned for convenient access thereto and for operative positioning of the same in the electrical circuit means for the lamp or globe.

The general object of the present invention is to provide an improved bracket and lamp globe mounting apparatus or the like which is characterized by the use of a plurality of identical support brackets therein.

Another object of the invention is to provide a lamp globe mounting apparatus or equivalent structure wherein a horizontally positioned carrier and spacer tube of variable length is provided to support a separate globe support post in laterally offset relationship to the center post in the lamp globe assembly.

Another object of the invention is to provide lamp globe or lantern mounting apparatus especially adapted for positioning a plurality, such as four, lamp globes on a common center support post in uniformly spaced relationship to such center post.

Further objects of the invention include providing support brackets in a lamp globe assembly or the like wherein a plurality, such as four, individual globes can be positioned on a common support post, but wherein the diameter of the support post is of minimum size and wherein portions of the support brackets used are cut off at predetermined angles in base portions thereof for abutting against the adjacent support brackets when the brackets are positioned on the common center post; to provide a novel and improved support bracket wherein two pairs of opposed brackets can be attached to a center support post and be positioned in the same horizontal plane; to provide an improved low cost, sturdy support apparatus for lamp globes and the like and for electrical starter members used in association therewith; and to provide support apparatus of a neat, attractive appearance.

The foregoing and other objects and advantages of the invention will be made more apparent as the specification proceeds.

In the accompanying drawings.

When referring to corresponding members shown in the drawings and referred to herein, corresponding numerals are used to facilitate comparison between such members.

SUBJECT MATTER OF INVENTION

Figure 1:
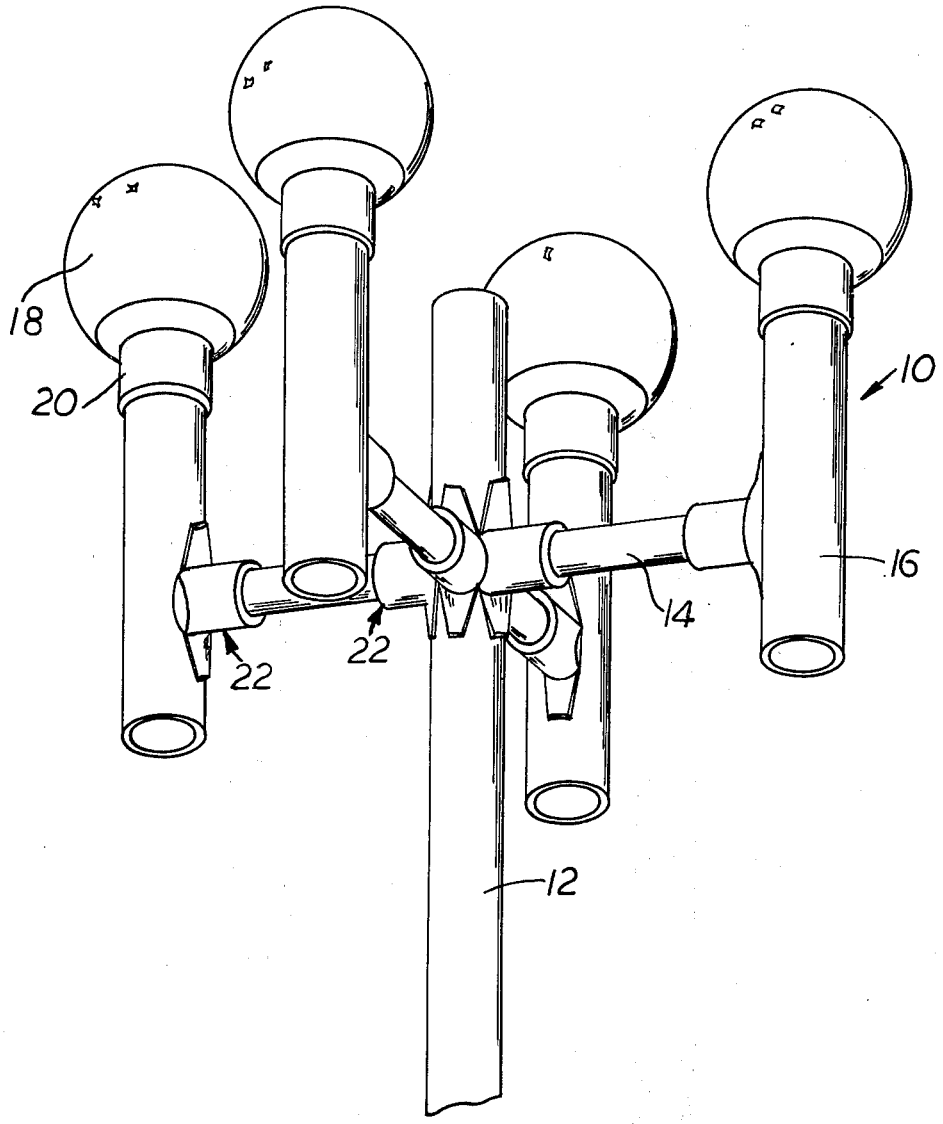
FIG. 1 is a perspective view of a lamp globe mounting apparatus embodying the principles of the invention.
Figure 2:
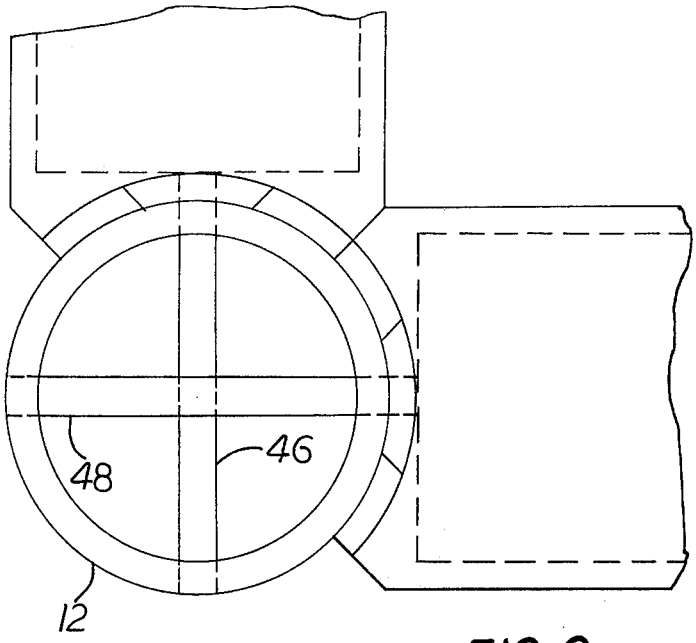
FIG. 2 is a fragmentary section through the center support post indicating a pair of brackets in operative engagement therewith.

A lamp globe support apparatus or the like, including as one embodiment of the invention, apparatus comprising a tubular center support post, an auxiliary tubular support for a lamp globe or the like and wherein the apparatus is characterized by a first bracket including a cup-shaped socket attached to the post and a second bracket identical with the first and attached to the tubular support, the cup-shaped brackets being positioned in the apparatus in directions opposing each other, and a carrier tube adapted to have end portions received in and positioned by the sockets to have the carrier tube extend therebetween, the carrier tube being adapted to position electric starter and connection means therein and being readily connectable to electrical means in the support post and in the tubular support. Also, the apparatus includes means for securing a pair of brackets in diametrically opposed relationship to each other on the center support and a second pair of brackets positioned in abutting relationship with the first pair of brackets and with all of such brackets being in a common plane having their cup-shaped sockets spaced 90° from each other and wherein the four brackets extend completely around the circumference of the center support post in a common horizontal plane, but with the brackets being readily removable from the post for repair and inspection purposes, as desired, which brackets also are in removable engagement with the auxiliary tubular support post provided in the apparatus whereby the apparatus is adapted to position a plurality of lamp globes or the like in a common horizontal plane but in laterally spaced relationship to the center support post.

Reference now is made to the details of the construction shown in the accompanying drawings, and a bracket and lamp globe mounting apparatus is indicated as a whole by the numeral 10. This apparatus 10 normally comprises a tubular center support post 12, a horizontally positioned carrier tube 14 and a vertically positioned auxiliary tubular support post 16. These auxiliary tubular supports 16 normally are on vertical axes and are positioned in laterally offset relationship to the center post to position any desired type of a lamp globe, lantern 18 or the like at the upper end of each tubular support. Such globes 18 can be attached to the tubular support 16 by any conventional members including connector means 20.

It is a feature of the invention that novel and improved brackets 22 are used to secure the carrier tubes 14 individually to the support post 12 and for securing the tubular supports 16 to the other ends of the carrier tubes 14. As indicated in the drawings, each of the brackets 22 includes a cup-shaped socket 24 protruding from the bracket in one direction and the brackets 22 have elongated base flanges 26 protruding from the base portions of the bracket in opposed relationship and with the flanges 26 being axially directed. The drawings clearly show that the bottom surface of these flanges 26 and of the brackets 22 as a whole are of concave shape as indicated at 28.

Figure 5:
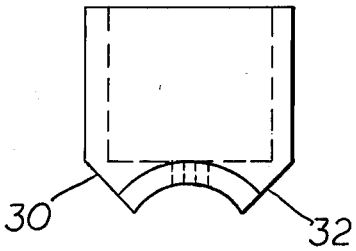
FIG. 5 is a right side elevation of the support bracket of FIG. 4.

The drawings indicate that four of these brackets 22 can be positioned in abutted relation in a horizontal plane and be supported on the center support post 12. To achieve such abutted relationship, or almost interlocked relationship of the brackets on the support posts, pairs of opposed edges 30 and 32 of each bracket are downwardly and inwardly slanted usually at 45° angles to the cup axis, as indicated best in FIG. 5 and where such edges on the adjacent brackets would abut each other, such as the edge 30 of one bracket engaging the edge 32 of the adjacent bracket, and vice versa. Hence, the brackets can be of relatively small size to be positioned, for example, on a 4 inch diameter post and have one or up to four globes mounted on this post in relatively close lateral association to the center support post.

Figure 3:
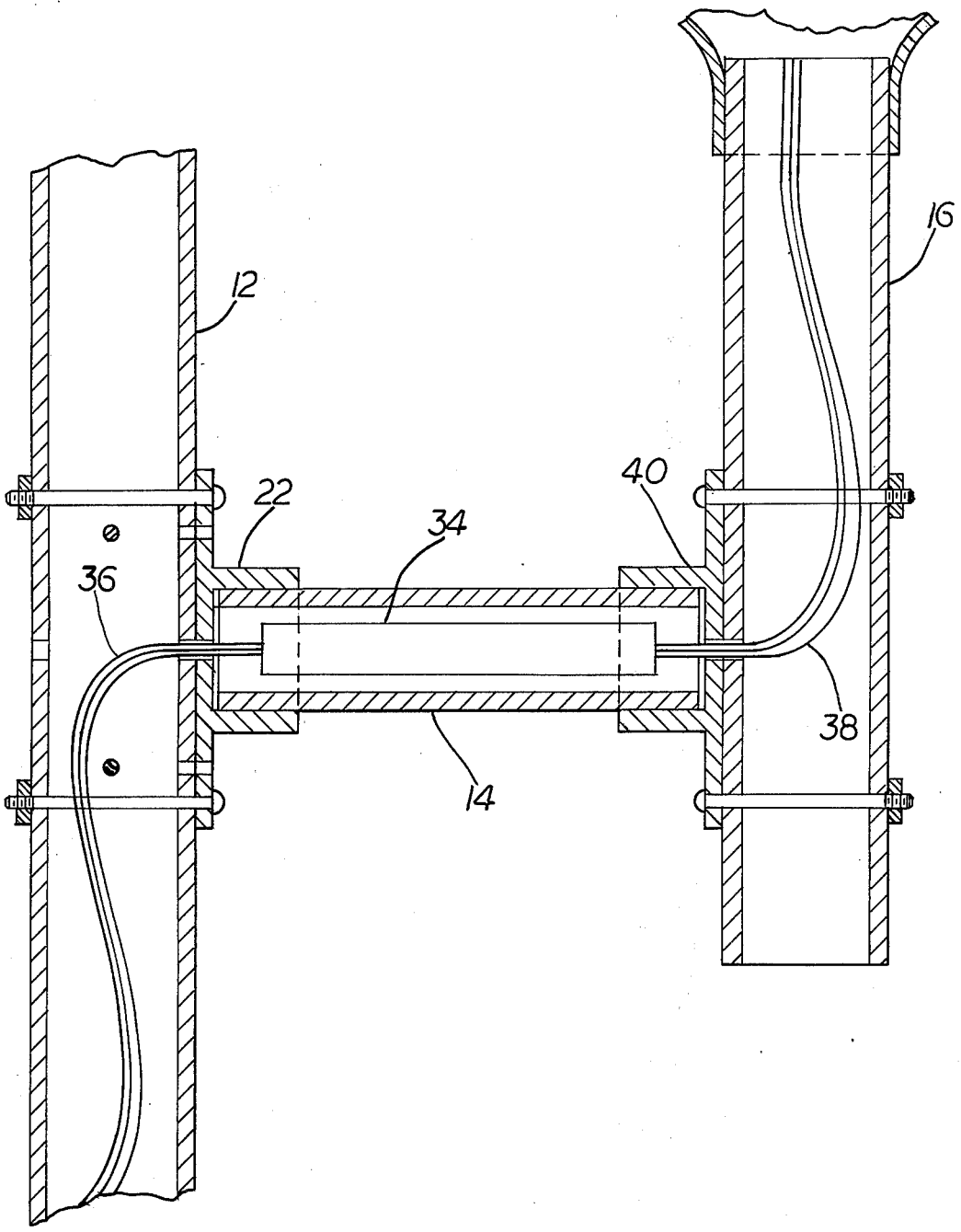
FIG. 3 is a fragmentary vertical section through the center support post and one mounting assembly for the lamp globe of the apparatus shown in FIG. 1.

FIG. 3 of the drawings best shows that electrical starter and connector means of a conventional nature are indicated at 34 and are positioned within and carried by the individual carrier tubes 14. Leads 36 and 38 extend from opposite portions of the starter means 34 to connect to leads from the adjacent tubular support 16 and the center post 12, respectively, in any known manner, whereby all of the rather bulky or large starter means required in the individual lamp assemblies is neatly positioned in the apparatus and is available for inspection and repair as is necessary. Holes 40 are provided in the bases of the cup-shaped sockets 24 for passing the leads therethrough and similar holes are provided in the associated support tubes.

Figure 4:
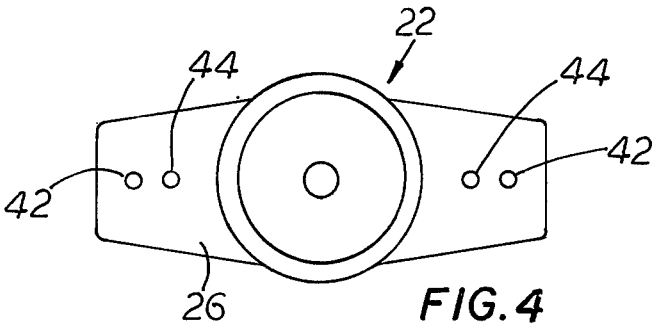
FIG. 4 is a top plan of the support bracket of FIG. 1.
Figure 6:
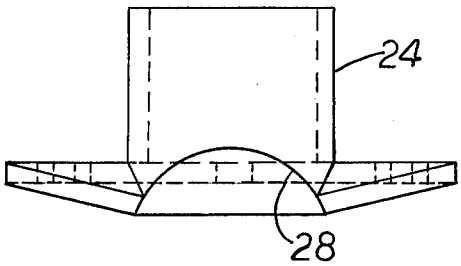
FIG. 6 is a front elevation of the bracket of FIG. 4.

FIG. 4 of the drawings best shows that each of the opposed ends of the base flanges 26 in the brackets are provided with a pair of axially spaced holes 42 and 44 in each end thereof. These holes 42 and 44 are in axially offset relationship with each other so that when four of the brackets are positioned in a common plane and attached to the center support post, one set of bolts 46 would extend through between the opposed sets of holes 42 in the base flanges and then the other sets of bolts 48 securing the opposite pair of opposed brackets in position would extend through the end holes 44 so that these bolts would not interfere with each other interiorly of the center support post.

By positioning all of the members in engagement with each other by removable bolts and the like, then the carrier tubes and the contents thereof are ready for inspection conveniently and for repair or service, as required. Or, the brackets could be riveted to the support tubes, as desired, so that the bolt means used could be of a permanent or removable type, as desired.

The design of the apparatus of the invention is neat and clean lined so that an attractive appearance is provided for the assembled lamp globes and the like.

By use of identical support brackets in a plurality of the individual globe mountings, the servicing and repair of the apparatus if facilitated and inventory requirements are kept to a minimum by the use of such brackets and by the carrier tubes being formed from conventional pipes or the like. The carrier tubes 14 can be varied in length in different assemblies dependent upon the size of the lamp supported and the size of the starter and/or electrical control means required. The apparatus is sturdy and provides an attractive design at minimum expense and is readily assembled by relatively unskilled help. Obviously, the electrical connections to the starter means 34 can be positioned within the carrier tubes 14 by extending the connecting leads from the adjacent support posts into the carrier tube, and the lamp means supported can depend from the posts 16. Normally, the brackets of the invention particularly are desirable for use with tubular support means, but if desired, a square shaped tubing can be used, but some benefits of the invention are not thereby fully realized. A compact, small, cylindrical center support tube is usable by the apparatus of the invention by the special interengaging relationship of base portions of the mounting or support brackets. Hence, it is believed that the objects of the invention have been achieved.

While one complete embodiment of the invention has been disclosed herein, it will be appreciated that modification of this particular embodiment of the invention may be resorted to without departing from the scope of the invention.

What is claimed is:

1. A lamp globe support apparatus, or the like, including support members comprising a tubular center support post and an auxiliary tubular support for a lamp globe characterized by a first bracket including a base and a cup-shaped socket, which bracket is attached to said support post and a second bracket including a base and a cup-shaped socket identical with the first bracket and attached to said auxiliary support, said brackets each having opposed elongated base flanges extending perpendicular to the center axis of its said socket and protruding beyond said socket in opposed aligned relation, a carrier tube with end portions received in said sockets and extending therebetween, said support members being parallel and vertical, said brackets being positioned to have said cup-shaped sockets facing towards each other and having a common center axis, and electrical starter and connection means in said carrier tube for connecting to electrical lead means in said support post and said tubular support, said brackets having flat surfaces in opposed marginal base areas thereof at said sockets which surfaces converge inwardly and downwardly of said brackets, said brackets being so shaped and sized that four brackets can be operatively positioned on said support post to have said sockets extend from such support post with the center axes of said sockets being in the same horizontal plane with 90° angles between said brackets, and said flat surfaces of adjacent ones of said brackets are in contact.

2. A lamp globe support apparatus, or the like, including support members comprising a tubular center support post and an auxiliary tubular support for a lamp globe characterized by a first bracket including a base and a cup-shaped socket, which bracket is attached to said support post and a second bracket including a base and a cup-shaped socket identical with the first bracket and attached to said auxiliary support, said brackets each having opposed elongated base flanges extending perpendicular to the center axis of its said socket and protruding beyond said socket in opposed aligned relation, a carrier tube with end portions received in said sockets and extending therebetween, said support members being parallel and vertical, said brackets being positioned to have said cup-shaped sockets facing towards each other and having a common center axis, and electrical starter and connection means in said carrier tube for connecting to electrical lead means in said support post and said tubular support, four of said tubular supports being provided, said bracket base having concave base surfaces positioned against said support post, or tubular support on which the individual bracket is positioned, four of said first brackets being positioned immediately adjacent each other around the periphery of said support post with the center lines of said sockets lying in a common horizontal plane, said first brackets each having opposed inclined flat base areas inwardly angled in relation to the center axis of said sockets and extending toward said support post, the inclined flat base areas of adjacent first brackets being in contact.

* * * * *